US005806094A

United States Patent [19]

Kasun et al.

[11] Patent Number: 5,806,094

[45] Date of Patent: Sep. 15, 1998

[54] LIGHT WEIGHT UPPER TORSO OUTER GARMENT ASSEMBLY FOR USE BY A CHILD

[76] Inventors: Timothy J. Kasun; Angela L. Kasun, both of 132 E. Sherman St., Bartlett, Ill. 60103

[21] Appl. No.: 844,377

[22] Filed: Apr. 18, 1997

[51] Int. Cl.[6] ..... A41B 1/12

[52] U.S. Cl. ..... 2/69; 2/243.1; 2/115

[58] Field of Search ..... 2/69, 115, 113, 2/114, 108, 1, 243.1, 50, 48, 51, 74, 75, 77, 105, 106, 116

[56] References Cited

U.S. PATENT DOCUMENTS

| | | | |
|---|---|---|---|
| D. 193,132 | 7/1962 | Rhoads | 2/51 |
| 3,259,913 | 7/1966 | Tames | 2/48 |
| 3,860,967 | 1/1975 | Tedesco . | |
| 4,266,299 | 5/1981 | Beal . | |
| 5,033,115 | 7/1991 | Bowling et al. . | |
| 5,293,646 | 3/1994 | Winston . | |
| 5,414,867 | 5/1995 | Bowling et al. . | |
| 5,418,978 | 5/1995 | Hochman . | |
| 5,586,339 | 12/1996 | Lathan . | |

*Primary Examiner*—Gloria M. Hale
*Attorney, Agent, or Firm*—Meroni & Meroni

[57] ABSTRACT

The apparatus and method for making an outer garment assembly for use by a child wearing underlying clothing when making arts and crafts. The assembly comprises an upper torso covering structure for loosely-hanging encirclement about a child. The assembly also includes a non-elastic collar structure for selectively sizable loose-fitting neck-encompassing positioning about a child's neck. First and second sized sleeve members are connected to the upper torso covering structure. A pair of elongated, knit-elastic cuff structures are connected to each respective first sleeve and second sleeve, for snugly-fitting, wrist-encompassing engagement around a child's wrist. The upper torso covering structure includes a continuous front surface and a vertically split back surface. A right and left pair of shortened bottom-side edges are located along respective right and left side edges between the continuous front surface and the vertically split back surface. The vertically split back surface includes a reclosable split back for selectively opening and closing the back surface to enable the child to become encircled by the upper torso outer garment assembly without the child having to pull the upper torso outer garment assembly over a head of the child.

21 Claims, 11 Drawing Sheets

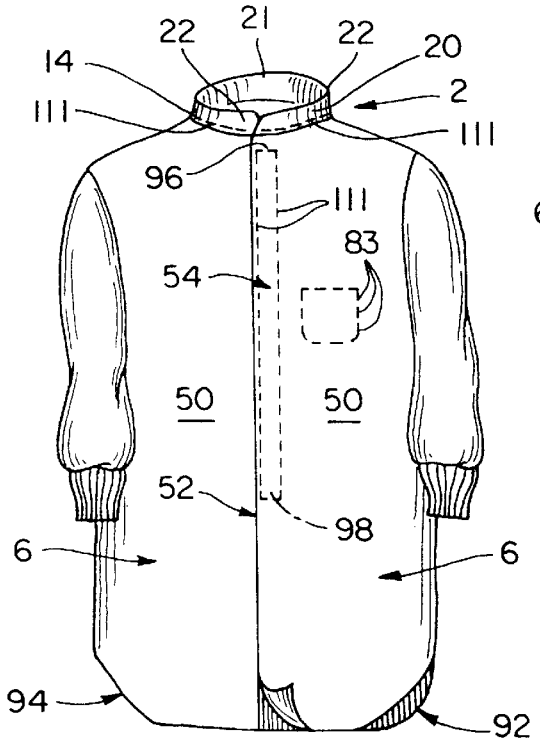
Fig. 2
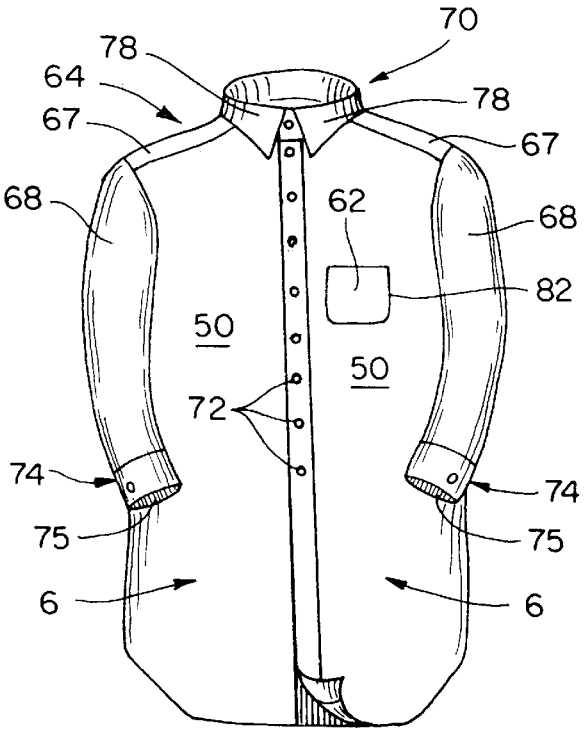
Fig. 3
Fig. 3a
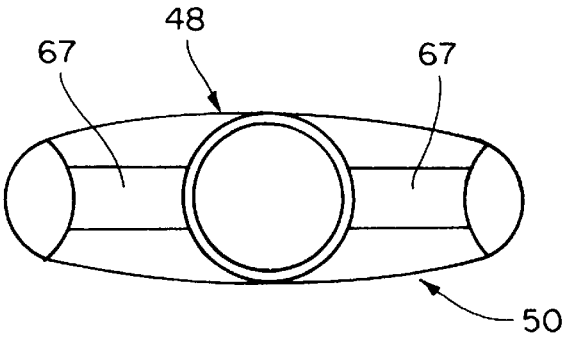
Fig. 3b
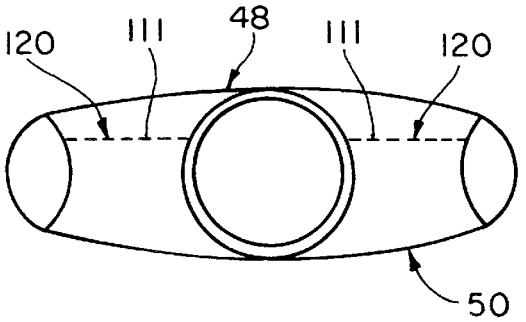

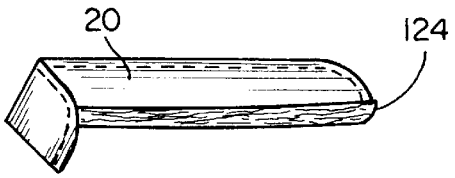
Fig. 17
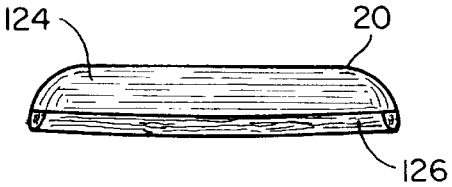
Fig. 18
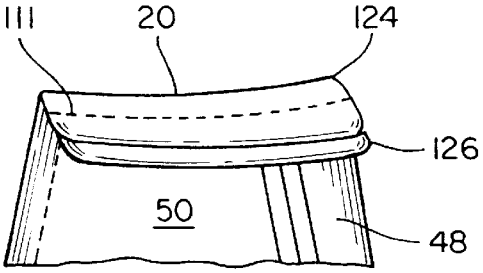
Fig. 19
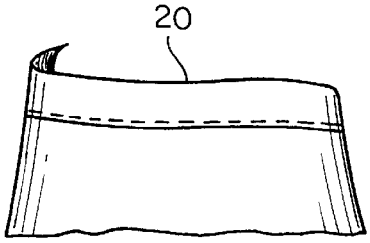
Fig. 20
Fig. 21
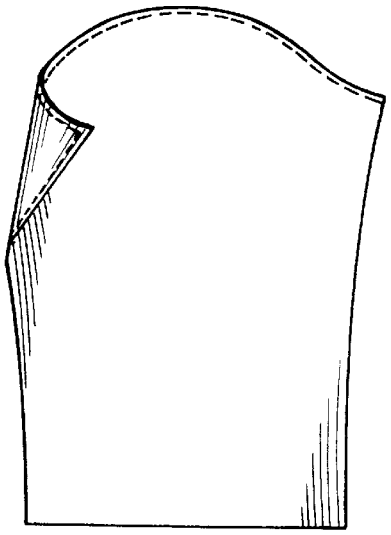
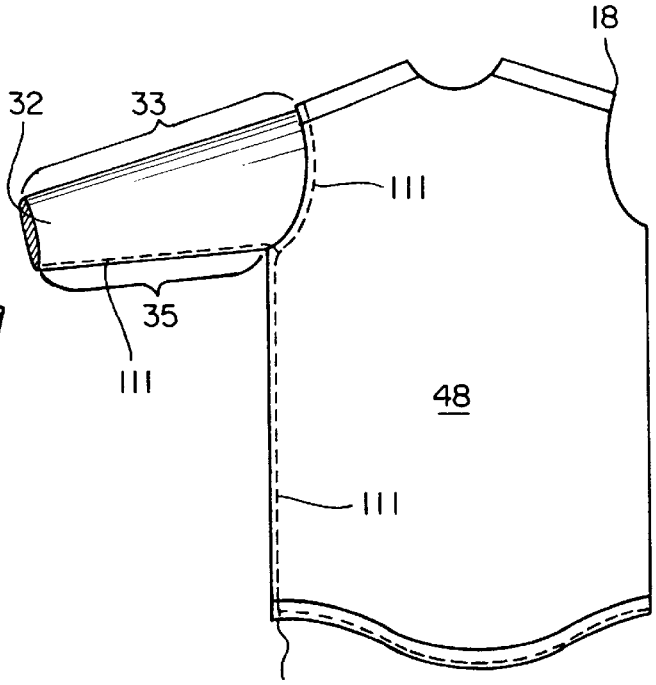
Fig. 22

LIGHT WEIGHT UPPER TORSO OUTER GARMENT ASSEMBLY FOR USE BY A CHILD

BACKGROUND OF THE INVENTION

1. Field of the Invention

The present invention relates generally to a protective garment to be worn over one's underlying clothing. More particularly, our invention relates to an apparatus and method for making the apparatus known as a new and improved light weight upper torso outer garment assembly for use by a child wearing underlying clothing when making arts and crafts and the like.

2. Description of the Prior Art

Various protective garment covering structures exist in the prior art. Aside from having the same general purpose of providing a protective covering for an individual's person, with and without another garment worn underneath the protective garment covering structure, the prior art devices serve a variety of different specific purposes. These specific purposes dictate the structure and function employed by a prior art device to adequately serve a particular purpose. For example, U.S. Pat. No. 5,586,339 shows an "Outer Protective Garment Apparatus" for protectively covering a user's torso and extremities from contamination by entry of a contaminate via the extremities. Another patent, U.S. Pat. No. 5,414,867, shows a "Disposable Garment for Use In Emergency Situations" for protecting a wearer when caring for potentially infectious victims in an emergency situation. Yet further examples are seen in the other prior art patents disclosed and cited with our application here.

In similar fashion, the specific purposes of our invention have also resulted in structural and functional characteristics unique to the purposes of our invention. For example, when a child desires to use a protective outer garment assembly, the garment must be long enough to cover the upper torso portion of the child, yet not too long to interfere with the child's movement when walking or moving about a room while making arts and crafts and the like. Also, the garment assembly must be comfortable to the child who may be wearing the garment for an extended period of time. Absent certain comfort features, a child is inclined to remove the garment assembly or alter its intended configuration to make it comfortable, in each case defeating the protective purpose of the garment.

Such comfort features should include elongated knit cuffs that comfortably, yet firmly, engage a child's wrist to maintain the position of the cuff adjacent to the child's wrist and also to prevent the underlying clothing from exposing itself to an environment outside the outer garment assembly when the child is making arts and crafts. Another comfort feature would be a non-elastic collar structure being selectively sizable and providing loose-fitting neck-encompassing positioning about a child's neck for preventing the underlying clothing from exposing itself to an environment outside the outer garment assembly.

Yet another comfort feature would be providing the garment assembly with a circumferentially non-constricted lower torso portion, where the garment assembly as a whole hangs freely from the child's shoulders affected only by the force of gravity and is not gathered at a waist portion of the child. Still another comfort feature concerns putting on and taking off the garment assembly. Sometimes a child is physically unable to place a garment assembly over their head and thus in order to insure that a child will use the garment assembly the child must be able to put the garment assembly on and off without putting it over their head. Along this same line, a garment assembly should be put on and taken off without going over one's head to prevent foreign materials (e.g., paint and crafts) on the garment assembly after use by a child from getting on the child's person or underlying clothing when the garment is removed by the child.

Another requirement of the garment assembly to be worn by a child is that is must be economical to make and use so that children (and their families) of all economic backgrounds can enjoy the benefits of the garment assembly. Thus, such an assembly must be reusable. Also, if the assembly can be constructed from merely modifying an ordinary existing device, this would also serve to reduce the ultimate costs of the garment assembly.

Yet another requirement of a garment assembly to be worn by a child is that is must be easy to use where either the child himself or another child or adult can easily secure the garment assembly to the child with minimum efforts. Thus, such an assembly should require a minimum number of closure members and the closure member(s) should employ either a hook-and-loop fastener of the type commonly sold under the trademark VELCRO™ or a set of snap type fasteners. Also, the closure member(s) should make it easy for a child to sit down by being able to spread a front lower edge portion of the garment over the child's pant legs while sitting down.

Still another requirement of a garment assembly to be worn by a child is that is must be reliable so that the user (and more particularly the user's parents or guardians) can be reasonably assured that the garment assembly will adequately protect the child's underlying clothing, which could be a costly outfit or other clothing structure. Thus, such a garment assembly should have a continuous front surface and it should extend from a should portion of a child to below a waist portion of the child. Also, a front portion of the ultimate garment assembly to be worn should comprise a one piece or integrally connected front surface portion.

These and other types of protective garment structures disclosed in the prior art do not offer the flexibility and inventive features of our invention. As will be described in greater detail hereinafter, the structural and functional features of the present invention differs from those previously proposed, offer the advantages desired by such a garment assembly and overcome the problems in the existing protective garment covering structures.

OBJECTS AND SUMMARY OF THE INVENTION

It is an object of our invention to provide a loose fitting light weight upper torso outer garment assembly for use by a child wearing underlying clothing in order to protect the underlying clothing by prevent the underlying clothing from exposing itself to an environment outside the outer garment assembly when the child is making arts and crafts and the like.

It is another object of our invention to provide an economical and easy to use loose fitting light weight upper torso outer garment assembly for use by a child wearing underlying clothing in order to protect the underlying clothing.

It is yet another object of our invention to provide an upper torso outer garment assembly for use by a child wearing underlying clothing where the garment can be put on and taken off by the child without the garment assembly being pulled over the child's head.

It is another object of our invention to provide a garment with a circumferentially non-constricted lower torso portion, where the garment assembly as a whole hangs freely from the child's shoulders affected only by the force of gravity and is not gathered at a waist portion of the child but rather is open in a downward direction.

It is still a further object of our invention to provide a new method for making our upper torso outer garment assembly from an adult dress shirt by making modifications thereto.

It is another object of our invention to provide a new method for making our upper torso outer garment assembly from a pattern structure and cutting out pattern parts from a sheet of material and then assembling the pattern parts to make our invention.

To achieve the foregoing and other objectives, and in accordance with the purposes of the present invention, we have provided a new and improved light weight upper torso outer garment assembly for use by a child wearing underlying clothing when making arts and crafts. Our assembly comprises an upper torso covering structure for loosely-hanging encirclement about a child extending from a shoulder portion of a child to below a waist portion of a child and above a knee portion of a child, the upper torso covering structure including a neck aperture portion, a first arm aperture portion and a second arm aperture portion. Our assembly further comprises a collar member circumferentially secured to the neck aperture portion for selectively sizable loose-fitting neck-encompassing positioning about a child's neck and for preventing the underlying clothing from exposing itself to an environment outside the outer garment assembly when the child is making arts and crafts. A first sized sleeve member having a first sleeve upper end and a first sleeve lower end is completely circumferentially connected to the first arm aperture portion A second sized sleeve member having a second sleeve upper end and a second sleeve lower end is completely circumferentially connected to the second arm aperture portion. Our assembly further comprises a pair of elongated, knit-elastic cuff structures for snugly-fitting, wrist-encompassing engagement around a child's wrist and for preventing the underlying clothing from exposing itself to an environment outside the outer garment assembly when the child is making arts and crafts, each of the pair of elongated, knit-elastic cuff structures being completely circumferentially connected to each respective first sleeve and second sleeve lower ends. The upper torso covering structure includes a continuous front surface and a vertically split back surface. A right pair of shortened bottom edges are located along a right side edge between the continuous front surface and the vertically split back surface and a left pair of shortened bottom edges are located along a left side edge between the continuous front surface and the vertically split back surface. The right and left pairs of shortened bottom edges assist the child in moving about and sitting down while wearing the upper torso outer garment assembly. The vertically split back surface includes a pair of opposed vertically extending back ends and a back end securing member for selectively opening and closing the back surface to enable the child to become encircled by the upper torso outer garment assembly without the child having to pull the upper torso outer garment assembly over a head of the child and for preventing the underlying clothing from exposing itself to an environment outside the outer garment assembly when the child is making arts and crafts.

According to other features in invention we have provided the front surface of the upper torso covering structure including a pocket member attached to the front surface with at least a portion of the pocket member being located in a horizontal plane coinciding with the pair of elongated, knit-elastic cuff structures. The pocket member serves to hold the child's art and craft tools and the like.

Another feature of our invention relates to the back end securing member from the group consisting of a snap type fastener and a hook-and-look type fastener. The back end securing member extends from a first position adjacent the non-elastic collar structure means to a second position in a range of one-half to three-quarters a vertical length of the pair of opposed vertically extending back ends. In this way, the positioning of the back end securing member assists the child in sitting down and positioning a front lower edge portion of the upper torso outer garment assembly over an upper leg portion of the child where the back end securing member is connected to the pair of opposed vertically extending back ends and thereby the pair of opposed vertically extending back ends are selectively securable together by operation of the back end securing member.

Yet other features relate to the collar member having a pair of opposed collar ends located adjacent the back end securing member. The pair of opposed collar ends are then selectively positioned together in coordination with the selective opening and closing of the pair of opposed vertically extending back ends where the pair of opposed collar ends themselves may engage each other but are not connected to each other.

Still another feature of our invention concerns the aesthetics of our invention. In particular, the vertically split back surface includes pocket stitching holes therein formed by the removal of a first stitching previously securing the pocket member in place. And, the collar member includes label stitching holes therein formed by the removal of a second stitching previously securing the label in place.

Other features relate to a method for converting an adult dress shirt into a new and improved light weight upper torso outer garment assembly for use by a child wearing underlying clothing when making arts and crafts. The adult dress shirt includes an upper torso covering structure, a pair of sleeves attached to the upper torso covering structure, a collar attached to the upper torso covering structure, a set of buttons attached to the upper torso covering structure by a third stitching, a pocket member attached to the upper torso covering structure by a first stitching, a pair of cuffs attached to the sleeves, a label attached to the collar by a second stitching, the collar consisting of an upper folded-over portion attached to a collar member having a pair of opposed collar ends, a right pair of shortened bottom edges located along a right side edge between the continuous front surface and the vertically split back surface, a left pair of shortened bottom edges located along a left side edge between the continuous front surface and the vertically split back surface. The improvement comprises the steps of converting the adult dress shirt by: removing the pair of cuffs, the label, the set of buttons, the pocket member and the upper folded-over portion; attaching a back end securing member from the group consisting of a snap type fastener and a hook-and-look type fastener to the pair of opposed vertically extending back ends; and, connecting a pair of elongated, knit-elastic cuff structures to the pair of sleeves.

Still other features relate to a second method for making a new and improved light weight upper torso outer garment assembly for use by a child wearing underlying clothing when making arts and crafts. Under this method our invention comprises the steps of: providing (1) a sheet of material for creating the upper torso outer garment assembly and (2) a pair of elongated, knit-elastic cuff structures; providing a pattern comprising pattern parts for cutting out pieces of material used in the manufacture of the upper torso outer garment assembly; sizing and cutting pieces of material from the sheet of material using the pattern parts to create (1)

a continuous front surface having a right front shortened bottom edge and a left front shortened bottom edge, (2) a vertically split back surface where the vertically split back surface includes a pair of opposed vertically extending back ends, a right back shortened bottom edge and a left back shortened bottom edge, (3) a first sleeve member including a left first sleeve edge and a right first sleeve edge, (4) a second sleeve member including a left second sleeve edge and a right second sleeve edge, (5) a collar member and (6) a pocket member; connecting the continuous front surface to the vertically split back surface at a top edge and thereby also forming a neck aperture portion; connecting the continuous front surface to the vertically split back surface at a left side edge and at a right side edge and thereby also forming a first arm aperture portion and a second arm aperture portion; connecting the collar member to the neck aperture portion; connecting the first sleeve member to the first arm aperture portion; connecting the second sleeve member to the second arm aperture portion; attaching a back end securing member from the group consisting of a snap type fastener and a hook-and-look type fastener to the pair of opposed vertically extending back ends; and, connecting one member from the pair of elongated, knit-elastic cuff structures to each respective first and second sleeve members.

Yet other features relate to giving a finished appearance to our garment assembly through the use of serge type stitching and folded-over, finished type edges.

DESCRIPTION OF THE DRAWINGS

FIG. 2 is a back view of our invention shown in FIG. 1;

FIG. 3 is a front view of a prior art adult dress shirt prior to converting it to our new and improved light weight upper torso outer garment assembly for use by a child wearing underlying clothing when making arts and crafts in accordance with the features of our invention;

FIG. 3*a* is a top view of the dress shirt shown in FIG. 3;

FIG. 3*b* is a top view of the an alternative embodiment of the dress shirt shown in FIG. 3, where the shoulder patch type jointing is replaced by a front top edge;

FIG. 17 is a front inside view of a two-piece collar member being assembled;

FIG. 18 is a front outside view of the collar member shown in FIG. 17, here demonstrating another step of assembly;

FIG. 19 is a side inside view of the collar member shown in FIG. 18, here demonstrating the collar member being attached to a neck aperture portion;

FIG. 20 is a side outside view of the collar member shown in FIG. 19, here demonstrating another step for finishing the collar member;

FIG. 21 is a top plan inside view of a sized sleeve member;

FIG. 22 is a front outside view of a sized sleeve member being connected to an upper torso covering structure and also demonstrating some steps for finishing the connection and edges;

DETAILED DESCRIPTION OF THE PREFERRED EMBODIMENT

Figure 1:
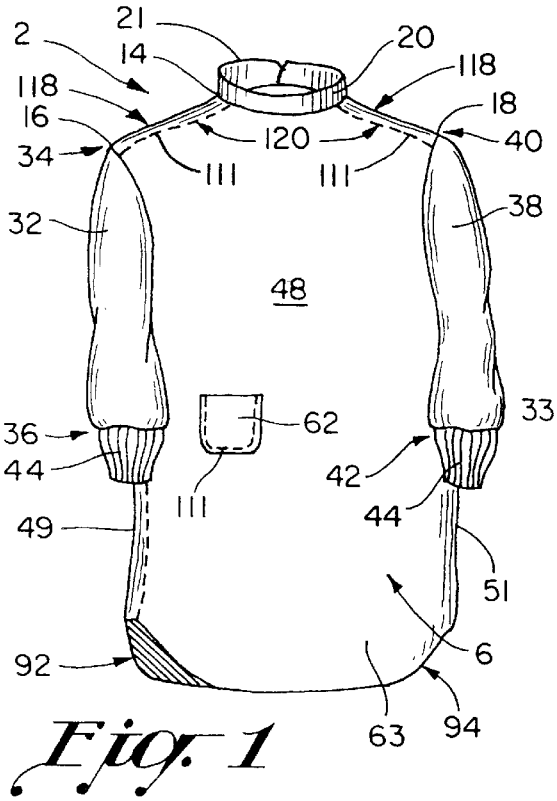
FIG. 1 is a front view of our new and improved light weight upper torso outer garment assembly for use by a child wearing underlying clothing when making arts and crafts, in accordance with the features of our invention.
Figure 1A:
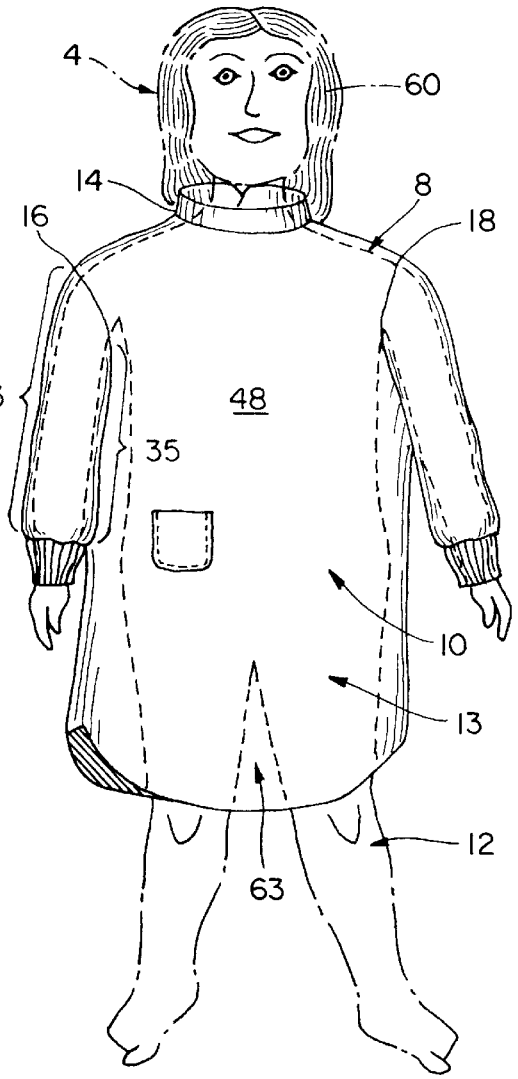
FIG. 1*a* is a front view of our garment assembly shown in FIG. 1, with a child wearing the garment assembly and those portions of the child's body underneath the garment assembly in dotted lines.
Figure 1B:
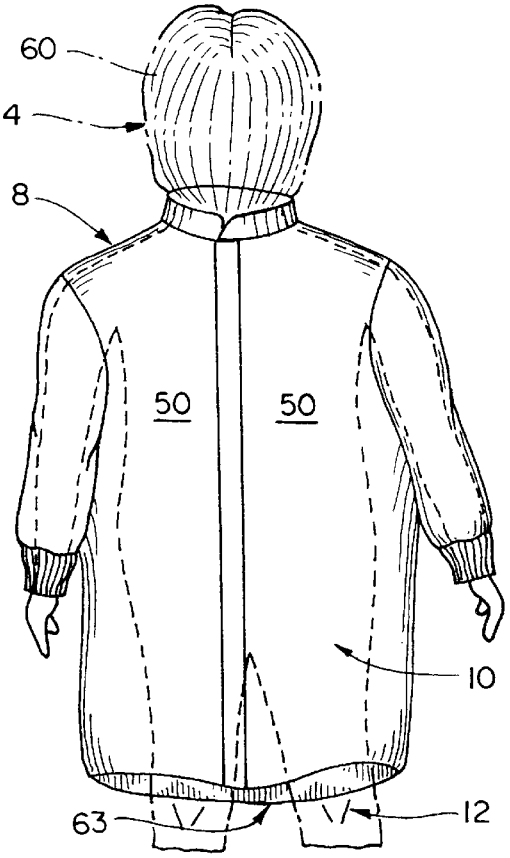
FIG. 1*b* is a back view of FIG. 1*a;*
Figure 1C:
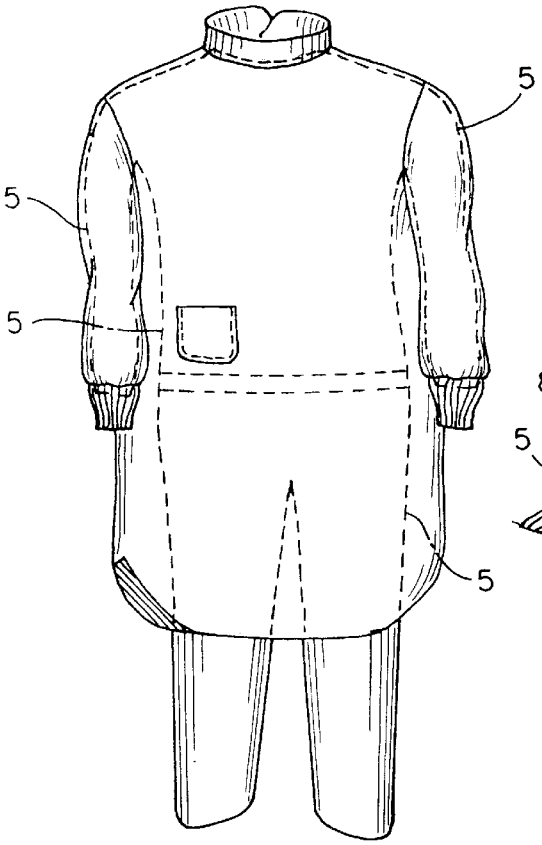
FIG. 1*c* is a front view of our garment assembly shown in FIG. 1, with a child's underlying clothing in the garment (without a child) and those portions of the child's underlying clothing underneath the garment assembly in dotted lines.
Figure 1D:
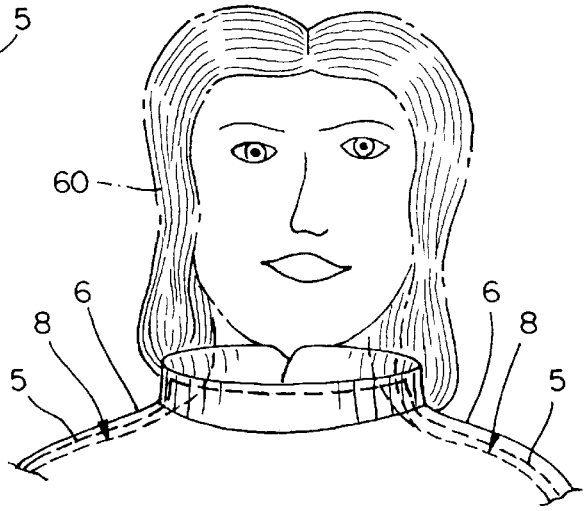
FIG. 1*d* is a partially exploded view of our garment assembly shown in FIG. 1*a*, here detailing a shoulder portion of the child in dotted lines underneath the child's underlying clothing in dotted lines underneath the garment assembly in solid lines.
Figure 1F:
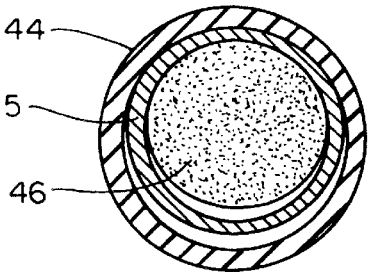
FIG. 1*f* is a cross sectional view along the line A—A shown in FIG. 1*a*.
Figure 1E:
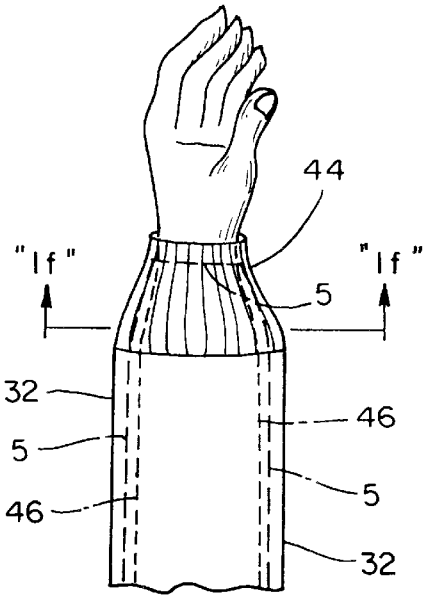
FIG. 1*e* is a partially exploded view of our garment assembly shown in FIG. 1*a*, here detailing a wrist portion of the child in dotted lines underneath the child's underlying clothing in dotted lines underneath the garment assembly in solid lines.

Referring now to the drawings, FIG. 1 shows our new and improved light weight upper torso outer garment assembly 2 for use by a child 4 wearing underlying clothing 5 when making arts and crafts and the like. The garment assembly 2 comprises an upper torso covering structure 6. Critical to the operation of our invention is the feature that the garment assembly 2 loosely-hang about a child encircling the child's upper torso area extending from a shoulder portion 8 to below a waist portion 10 and above a knee portion 12, and preferably which wholly hangs freely from the child's shoulders affected only by the force of gravity and is not gathered at a waist portion of the child but rather is open in a downward direction.

In this way, the garment assembly will adequately protect the child's underlying clothing but not in a restrictive manner thus leaving the child's upper torso area and arms able to move freely within the garment assembly. Also, the light weight material comprising the garment assembly must be of sufficient construction (preferably a polyester cotton blended material) to prevent paint, glue and the like from quickly passing through the garment assembly to a child's underlying clothing. However, the garment assembly must also be of a construction that does not retain an excessive amount of body heat from the child so the child will feel a comfortable temperature (e.g., room temperature) when wearing the garment assembly.

The upper torso covering structure includes a neck aperture portion 14, a first arm aperture portion 16 and a second arm aperture portion 18. Circumferentially connected to the neck aperture portion is a collar member 20. Excellent results are obtained when the collar member has a non-elastic characteristic to enable selectively sizable loose-fitting neck-encompassing engagement about a child's neck and for preventing the underlying clothing from exposing itself to an environment outside the outer garment assembly when the child is making arts and crafts.

The collar member includes a pair of opposed collar ends 22. In operation, the pair of opposed collar ends are selectively positionable together in coordination with the selective opening and closing of the pair of opposed vertically extending back ends and thereby the pair of opposed collar ends can be located so that the collar member loosely-fits in neck-encompassing engagement about the child's neck.

Completely circumferentially connected to the first arm aperture portion is a first sized sleeve member 32 having a first sleeve upper end 34 and a first sleeve lower end 36. Completely circumferentially connected to the second arm aperture portion is a second sized sleeve member 38 having a second sleeve upper end 40 and a second sleeve lower end 42. Under one embodiment of our invention utilizing an adult dress shirt 64 (seen in FIGS. 3 through 6), the first and second sized sleeve members are preferably sized longitudinally, employing the existing circumferential sleeve sizing of the dress shirt 64.

Completely circumferentially connected to each respective first sleeve and second sleeve lower ends is a pair of elongated, knit-elastic cuff structures 44. Critical to the operation of our garment assembly is that the cuff structures have the characteristic of providing snugly-fitting, wrist-encompassing engagement around a child's wrist 46 for preventing the underlying clothing from exposing itself to an environment outside the outer garment assembly when the child is making arts and crafts and for consistently locating the cuff structures adjacent the child's wrists. Excellent results are obtained when the cuffs have an elastic quality to them and they are constructed of a heavy knit material having an extended length for engagement around the child's wrist. In this way, the wrist engagement is comfortable to the child and sufficient to prevent the child's underlying clothing from working its way outside of the garment assembly as the child is making arts and crafts and the like.

The upper torso covering structure includes a continuous front surface 48 and a vertically split back surface 50. Concerning comfort in operation, it is desired that our garment assembly 2 include a right pair of shortened bottom edges 92 located along a right side edge 49 between the continuous front surface 48 and the vertically split back surface 50. On the opposite side of our garment assembly there is a left pair of shortened bottom edges 94 located along a left side edge 51 between the continuous front surface and the vertically split back surface. The right and left pairs of shortened bottom edges enable the child to move about and sit down relatively unimpeded while wearing the upper torso outer garment assembly. Also, the right and left pairs of shortened bottom edges 92 and 94 make it easier for a child to sit down and then spread the front lower edge portion 63 of the garment assembly over one's pant legs while sitting down.

The vertically split back surface includes a pair of opposed vertically extending back ends 52. The pair of opposed vertically extending back ends are selectively securable together by a back end securing member 54 from the group consisting of a snap type fastener 28 and a hook-and-look type fastener 30. In this way, the vertically split back surface can be selectively opened and closed to enable the child to become encircled by the upper torso outer garment assembly without the child having to pull the upper torso outer garment assembly over a head 60 of the child and for preventing the underlying clothing from exposing itself to an environment outside the outer garment assembly when the child is making arts and crafts. Also, because our garment assembly is not pulled over the child's head, it better enables the child to put the garment on without difficulty. Then, when taking off the garment assembly, by not having to pull the garment assembly up over one's head, the child is more likely to prevent foreign materials (paint and craft substances) from getting on their person or underlying clothing, in addition to the ease of not pulling the garment assembly over one's head.

Excellent results are obtained when the back end securing member 54 consists of a hook-and-loop fastener of the type commonly sold under the trademark VELCRO™. Also, to make it easier for a child to sit down and spread the front lower edge portion 63 of the garment over an upper leg portion 13 of the child, the back end securing member 54 should extend from a first position 96 adjacent the collar member to a second position 98 in a range of one-half to three-quarters a vertical length of the pair of opposed vertically extending back ends.

Another feature the preferred embodiment of our invention includes is a pocket member 62 attached to the front surface 48. Also, it is preferred that at least a portion of the pocket member be located in a horizontal plane coinciding with the pair of elongated, knit-elastic cuff structures. Through this placement, the pocket will be easily accessible to the child yet not too low such that it may get in the way of the child when he or she is making arts and crafts and the like.

Concerning dimensions for constructing our garment assembly, excellent results are obtained when the following particular dimensions are utilized: sizing each first and second sized sleeve member, 32 and 38 respectively, to have an overall outside length 33 of about 18 inches and an inside length 35 of about 14 inches; sizing each of the pair of elongated, knit-elastic cuff structures 44 to have an overall length of about 2 and ½ inches; sizing the upper torso covering structure 6 to have an overall length of about 28 inches. Sizing the collar member 20 to have an overall height of about 1 inch; sizing the back end securing member 54 to have an overall length of about 18 inches; and, locating the pocket member on a right side of the front surface 48 about 3 inches from a right side edge 49 and 12 inches below an imaginary line connecting the first sleeve upper end 34 and the second sleeve upper end 40.

As seen in FIGS. 3–6 inclusive, our invention disclosed and claimed herein further includes a method for making our new and improved light weight upper torso outer garment assembly 2 by converting an ordinary adult type dress shirt. Two known prior art preferred dress shirt embodiments are shown for illustration purposes here in FIGS. 3*a* and 3*b*, although others would likely fulfill the requirements of our invention. Although we explain a particular order (and the preferred order for this embodiment) for carrying out our method, it is contemplated that another order could be employed which would be obvious in light of our disclosure here and as such the other order would fall within the disclosed and claimed scope of our invention.

To begin this method for converting an adult dress shirt into a garment assembly for a child, one must first obtain or provide an adult dress shirt 64, such as may exist in the prior art shown in FIGS. 3*a* and 3*b*. In the usual situation, the dress shirt 64 includes an upper torso covering structure 6. A pair of sleeves 68, a collar 70, a set of buttons 72 and a pocket member 62, all attached to the upper torso covering structure as shown. A pair of non-elastic dress shirt material cuffs 74 are attached to the sleeves. A designer label 76 or the like is attached to the collar. And, the collar comprises an upper folded-over portion 78 attached to the collar member 20, where the collar member includes a pair of opposed collar ends 22.

A first step of the first embodiment of making our garment assembly 2 comprises removing the pair of cuffs 74, the label 76, the set of buttons 72, the pocket member 62 and the upper folded-over portion 78, in no particular order.

Figure 4:
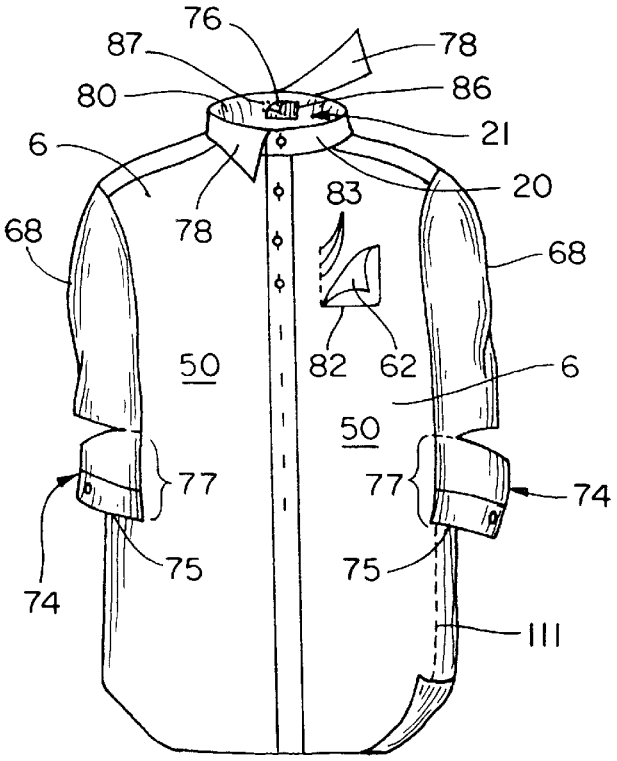
FIG. 4 is a front view of the dress shirt shown in FIG. 3, here demonstrating first steps for making our new and improved light weight upper torso outer garment assembly.
Figure 4A:
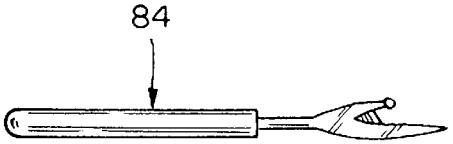
FIG. 4*a* is a front view of a seam ripper used in the converting method for making our invention.
Figure 4B:
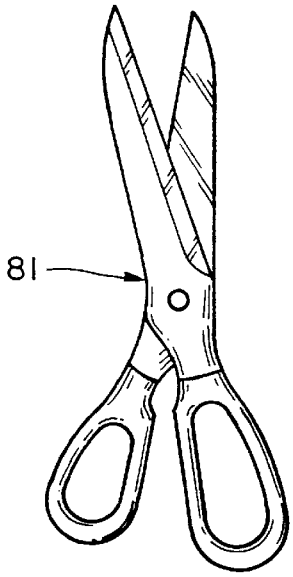
FIG. 4*b* is a front view of a scissors used in the converting method for making our invention.

Excellent results are obtained when the step of removing the upper folded-over portion 78 of the collar comprises cutting away the upper folded-over portion of the collar at a sew line 80. Cutting rather than unstitching or ripping out the sew line 80 reduces manufacturing time and effort and provides a collar member 20 having a sewn together upper edge 21. Moreover, the cutting is performed by use of a conventional scissors 81, as shown in FIG. 4*b*.

Further excellent results are obtain during the second step of our method when the step of removing the pocket comprises ripping a first stitching 82 securing the pocket to the torso portion by means of a seam ripper 84. In this way, the pocket member can be saved and used for later attachment to the front surface 48 as described hereafter.

Figure 4C:
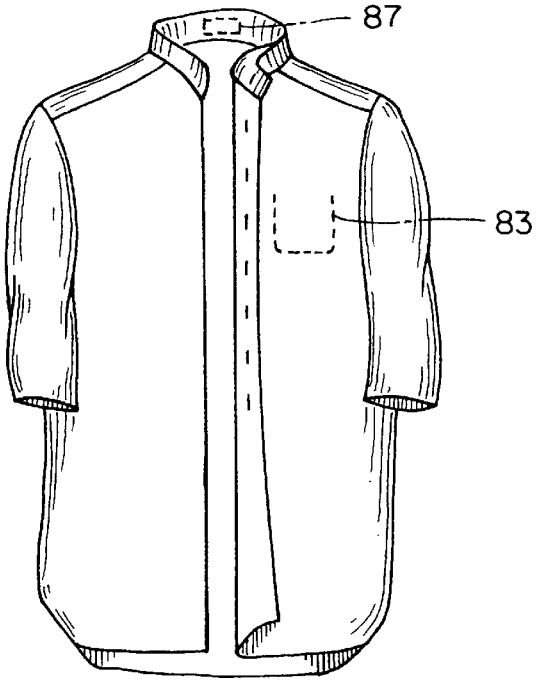
FIG. 4*c* is a front view of the dress shirt shown in FIG. 4, here demonstrating the dress shirt now fully prepared before adding elements to make our invention.

Still further excellent results are obtain during the second step of our method when the step of removing the label and the buttons comprises ripping a second stitching 86 securing the label to the collar member and ripping a third stitching (not shown in detail but comprising a conventional button stitching known in the art) securing the buttons 72 to the upper torso covering structure. Moreover, the ripping is preferably by means of the seam ripper 84. The buttons 72 and the label 76 can be discarded or reused as desired. Then, a completely prepared shirt 64 is shown in FIG. 4*c* ready for the addition of the unique elements that will comprise our garment assembly 2.

A second step of the first embodiment of making our garment assembly 2 comprises attaching a back end securing member 54 from the group consisting of the snap type fastener 28 and the hook-and-look type fastener 30, to the pair of opposed vertically extending back ends. Excellent results are obtained when the step of attaching the back end securing member, where using a hook-and-look type fastener includes a pair of mating members, comprises sewing by stitch each member of the pair of mating members to each respective opposed vertically extending back end of the pair of opposed vertically extending back ends 52. It should be understood that other means could also be employed such as gluing, taping or the like, but that stitching is preferred for ease and durability of our garment assembly.

Figure 30:
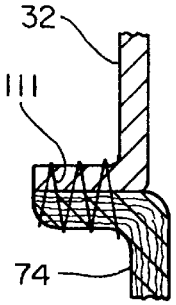
FIG. 30 is a partial exploded cross sectional view of a serge type sewn connection that connects each of the pair of elongated, knit-elastic cuff structures to a sized sleeve member; and, FIG. 31 is a partial exploded cross sectional view of a collar member sewn to a neck aperture portion.

Another step of the first embodiment for making our garment assembly 2 comprises connecting a pair of elongated, knit-elastic cuff structures 44 to the pair of sleeves 68. Excellent results are obtained when the step of removing the pair of cuffs includes respectively sizing a length 77 of the pair of sleeves, and in particular cutting the cuffs 74, about 5 inches from a bottom edge 75. Further excellent results are obtained when then the step of connecting the pair of elongated, knit-elastic cuff structures to the pair of sleeves comprises sewing the elongated, knit-elastic cuff structures to the pair of sleeves and in particular by means of a serge type stitch (FIG. 30).

A fourth step of the first embodiment of making our garment assembly 2 comprises sewing the pocket member 62 to the front surface with at least a portion of the pocket member being located in a horizontal plane coinciding with the pair of elongated, knit-elastic cuff structures.

An aesthetic feature of our invention, and unique because of its construction, is the vertically split back surface including pocket stitching holes 83 therein formed by the removal of a first stitching 82 previously securing the pocket member in place. In this same fashion, the collar member includes label stitching holes 87 therein formed by the removal of a second stitching 86 previously securing the label in place.

As seen in FIGS. 7*a*–23 inclusive, our invention disclosed and claimed herein further includes a second method for making our new and improved light weight upper torso outer garment assembly 2 from new materials. Although we explain a particular order (and the preferred order for this embodiment) for carrying out our second method, it is contemplated that another order could be employed which would be obvious in light of our disclosure here and as such the other order would fall within the disclosed and claimed scope of our invention.

To begin this method, one must provide a raw uncut sheet of material (not specifically shown but readily known in the art of garment making) of suitable quality (preferably a durable cotton polyester blend) to be used to construct our garment assembly. Using the pattern provided here, assembly time is conserved if the sheet is doubled over according to the pattern instructions hereafter.

A next step for this second method comprises providing a pattern, including five pattern parts, for cutting out pieces of material used in the manufacture of the upper torso outer garment assembly, all shown in FIGS. 7*a*–7*e* inclusive. Also, at this time it is economical to provide a conventional pair of elongated, knit-elastic cuff structures, for use later as described. As an aid in pattern making, the first guide arrows 122 represent two layers of material, one on top of the other, where the two pieces are not connected at their outer edges (i.e., there are two separate pieces of sheet material one on top of the other). Then, the second guide arrows 123 represent two layers of material, one on top of the other, such that the two pieces are connected at an outer edge adjacent where the guide arrow heads are pointing (i.e., one piece of sheet material folded over on itself with the folded side corresponding to the edge pointed at by guide arrows 123).

Figure 8A:
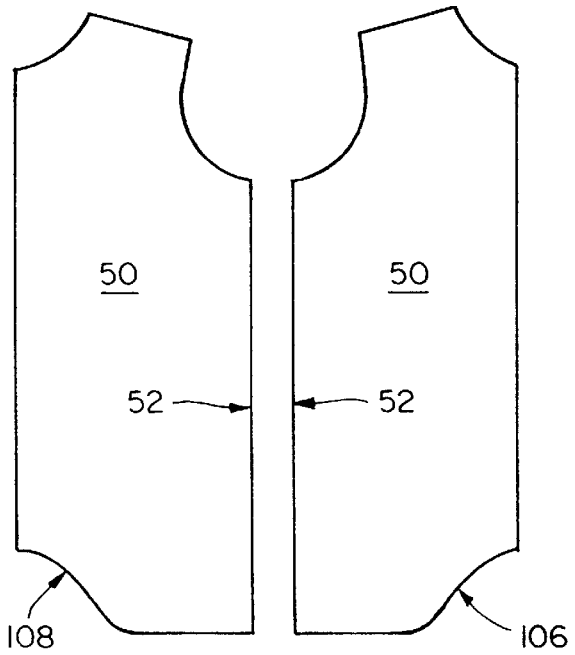
FIGS. 8*a*–8*e* are a top plan view of the pieces of material cut out using the pattern.
Figure 8B:
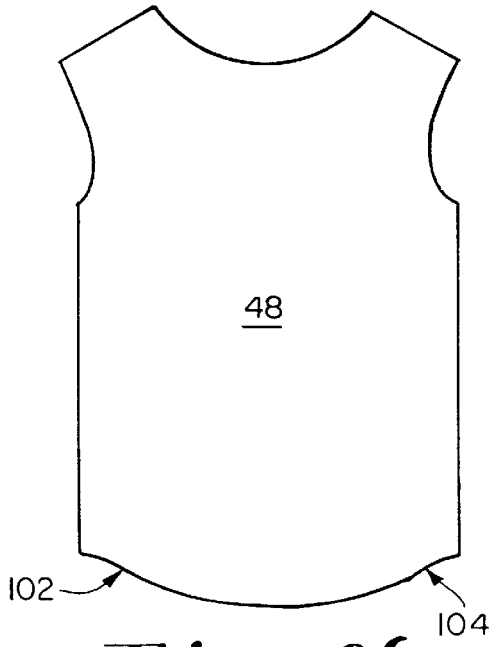
Figure 8D:
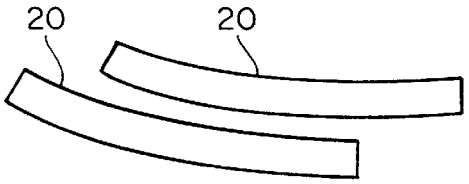
Figure 8C:
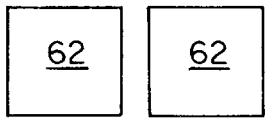
Figure 8E:
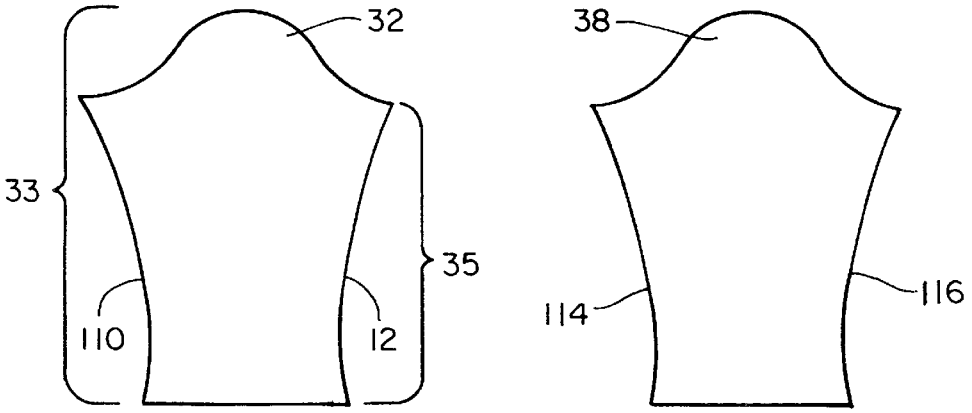

Next, the sheet of material is sized and cut using the pattern parts to thereby create the following pieces of material, shown laid out after cutting in FIGS. 8*a* through 8*e* inclusive: (1) a continuous front surface 48 having a right front shortened bottom edge 102 and a left front shortened bottom edge 104 (FIG. 8*b*); (2) a vertically split back surface 50 including a pair of opposed vertically extending back ends 52 and a right back shortened bottom edge 106 and a left back shortened bottom edge 108 (FIG. 8*a*); (3) a first sleeve member 32 including a left first sleeve edge 110 and a right first sleeve edge 112; (4) a second sleeve member 38 including a left second sleeve edge 114 and a right second sleeve edge 116; (5) a collar member 20; and, (6) a pocket member 62.

Figure 16:
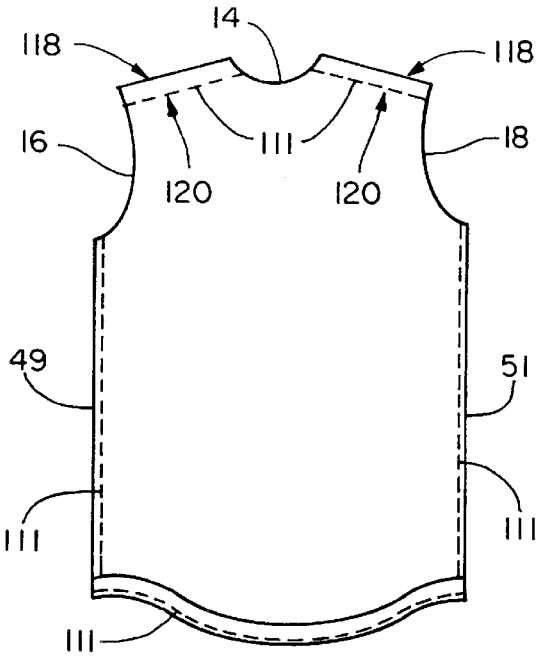
FIG. 16 is a front outside view of a continuous front surface being connected to the vertically split back surface at a front top edge.
Figure 16A:
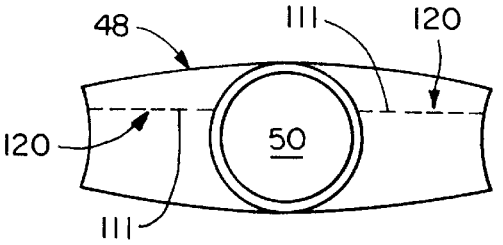
FIG. 16*a* is a top view of our invention shown in FIG. 16.
Figure 16B:
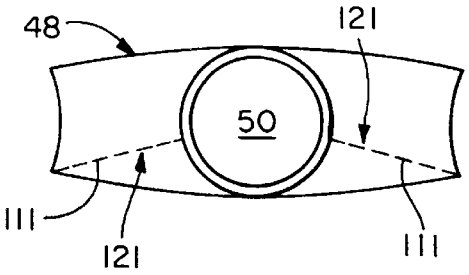
FIG. 16*b* is a top view of a continuous front surface being connected to the vertically split back surface at a back top edge according to an alternative preferred embodiment of our invention shown here.

Then, the continuous front surface is connected to the vertically split back surface at a top edge 118, thereby connecting these two members and also forming a neck aperture portion 14 (FIG. 16). Excellent and preferred results are obtained under this method of making my invention when the top edge 118 particularly comprises stitching together the continuous front surface and the vertically split back surface at a back top edge 121 extending diagonally backwards from the collar member towards the arm aperture portion, as shown in FIG. 16*b*. In this way, the vertically split back surface of the assembled garment assembly tends to pull the garment assembly backwards urging a front portion of the collar member to be pulled back against a front portion of the child's neck, thereby enhancing the operation of the collar member to comfortably prevent underlying clothing from exposing itself to an outside environment. Such a stitching is contrary to teaching in the art because it causes the garment assembly hang in a completely opposite way, which is preferred by our invention but which would not be so otherwise. Alternatively, the top edge 118 may comprise a front top edge 120 (FIG. 16A) and the features and advantages of our invention disclosed and claimed herein will be embodied therein, but not in as ideal an embodiment as we know to exist to date.

Another feature our invention may include is a pocket member 62. For manufacturing ease, if a pocket member is combined with our garment assembly, excellent results are obtained when the pocket member 62 is attached to the front surface 48 prior to connecting the continuous front surface to the vertically split back surface. Also, excellent results are obtained when the step of attaching the pocket member to the continuous front surface includes locating at least a portion of the pocket member in a horizontal plane coinciding with the pair of elongated, knit-elastic cuff structures (as the cuff structures will be located once the garment assembly is completely assembled).

Figure 12:
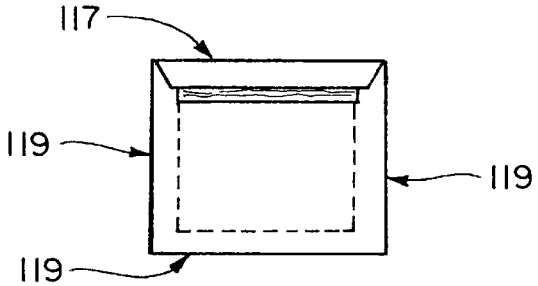
FIG. 12 is a front outside view of a two-piece pocket member being assembled.
Figure 13:
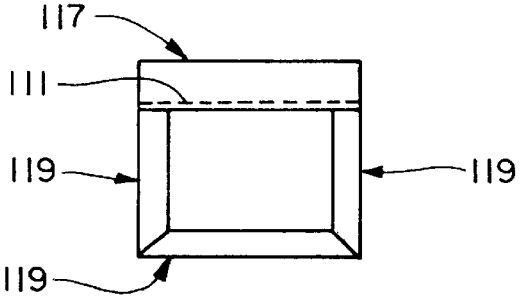
FIG. 13 is a front inside view of the pocket member shown in FIG. 12, here demonstrating another step of assembly.
Figure 14:
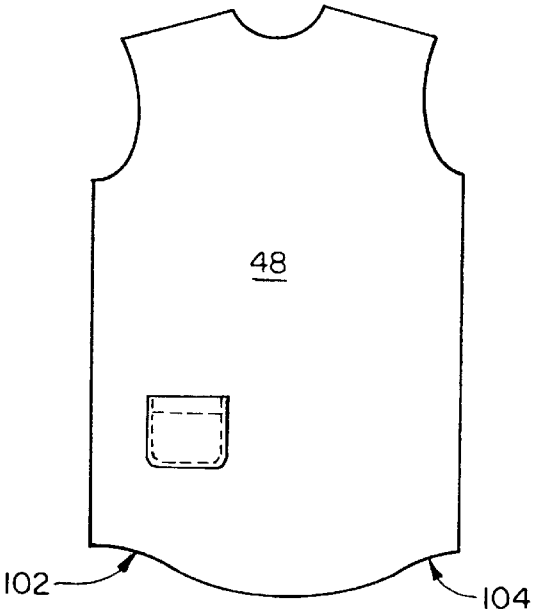
FIG. 14 is a front outside view of the pocket member shown in FIG. 13, here demonstrating the pocket member being attached to a continuous front surface.

Concerning the structure of the pocket, durability is enhanced if the pocket member consists of a two-piece pocket member sewn together as shown in FIGS. 12–14. In FIG. 12 a top pocket edge 117 is folded under and pressed. Then, the top pocket edge is turned to the outside forming a facing and stitched in place. Next in FIG. 13, other pocket edges 119 are turned to the inside and pressed. Then, the facing is turned to the inside and pressed and stitched. Finally, in FIG. 14 the assembled two-piece pocket is stitched to the front surface.

Figure 9:
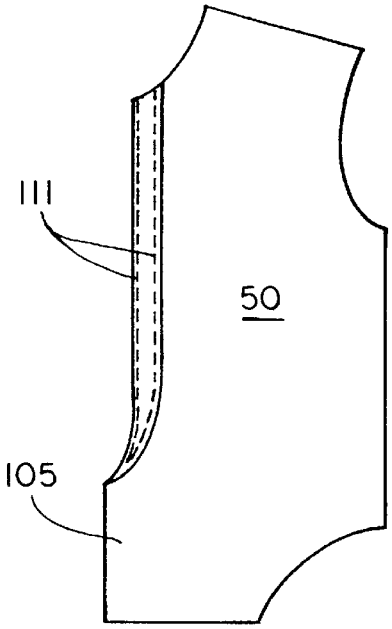
FIG. 9 is a back inside view of the piece of material shown in FIG. 8*a*, here performing a finishing step to the material.
Figure 10:
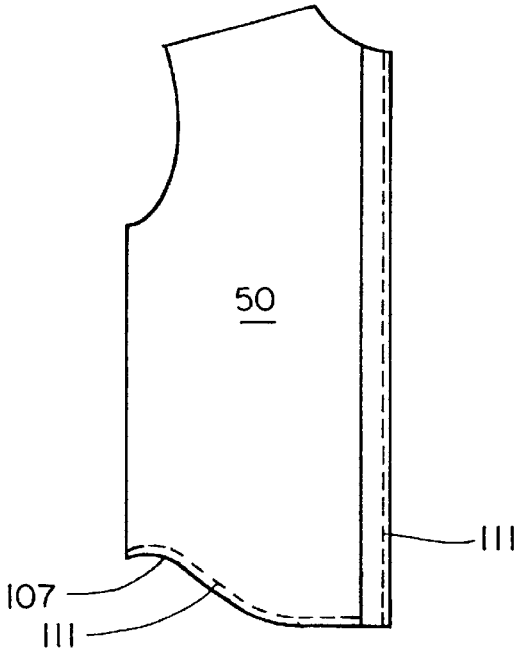
FIG. 10 is a back outside view of the piece of material shown in FIG. 9, here performing yet another finishing step to the material.
Figure 11:
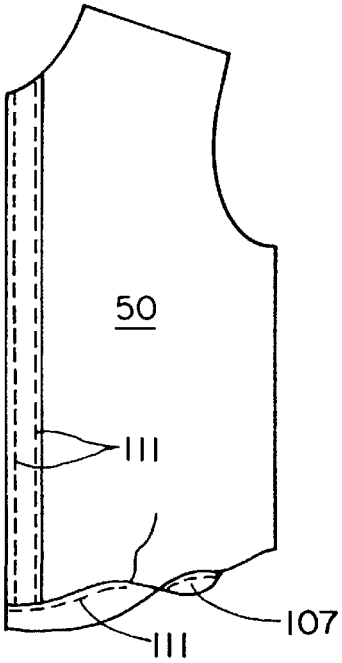
FIG. 11 is a back inside view of the piece of material shown in FIG. 10, here performing yet another finishing step to the material.

Additional excellent results towards achieving a finished product including the following steps, for each member of the pair of opposed vertically extending back ends, preferably performed before the continuous front surface is connected to the vertically split back surface shown in FIGS. 9–11 inclusive. In FIG. 9 a back end edge 105 is turned to an inside surface, and then one presses and bastes the edge 105. Next, in FIG. 10, the edge 105 is turned to the outside forming a facing and then pressed and stitched in place. Finally, in FIG. 11, the facing is turned to the inside and pressed. Then a hem is pressed up, a back end bottom edge 107 formed thereby is tucked under and stitched in place.

Figure 15:
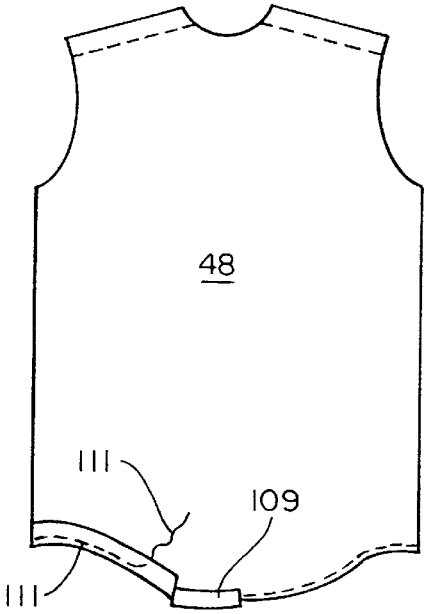
FIG. 15 is a front outside view of a continuous front surface, here demonstrating a finishing step to the material.
Figure 27:
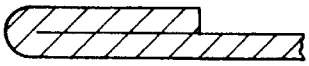
FIG. 27 is a partial exploded cross sectional view of a finished edge prior to sewing the edge in place.
Figure 28:
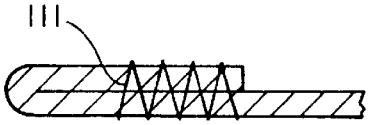
FIG. 28 is a partial exploded cross sectional view of the finished edge shown in FIG. 27, here being sewn in place.

Further excellent results towards achieving a finished product include the following steps, preferably performed before the continuous front surface is connected to the vertically split back surface, shown in FIG. 15. Here, a hem is pressed up and tucked under forming a front lower edge 109. Then, the edge is pressed and stitched in place by stitching 111. Shown in FIGS. 27 and 28 is demonstrated the partial exploded cross sectional view of the preferred finished appearance of all exposed edges, such as the pair of opposed vertically extending back ends 52, the front lower edge 109, the back end bottom edge 107 and the other pocket edges 119.

Figure 29:
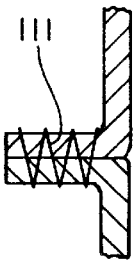
FIG. 29 is a partial exploded cross sectional view of a serge type sewn connection that connects various components of our garment assembly.

Next, shown in FIG. 16, the continuous front surface 48 should be connected to the vertically split back surface 50 at a left side edge 51 and at a right side edge 49, thereby connecting these two surfaces and also forming a first arm aperture portion 16 and a second arm aperture portion 18. When connecting the continuous front surface 48 to the vertically split back surface 50 at the top edge 118 as well as the left and right side edges 51 and 49 respectively, excellent results towards achieving a finished product include connecting the continuous front surface to the vertically split back surface by a serge type stitching, shown in FIG. 29.

Then, the collar member 20 is connected to the neck aperture portion 14, shown in FIG. 19 and 20. Excellent results are obtained when the collar member is stitched to the neck aperture portion 14 using a serge type stitch (shown in FIG. 29). Further excellent results are obtainable if after connecting the collar member to the neck aperture portion, the collar member is pressed, as shown in FIG. 20.

Figure 31:
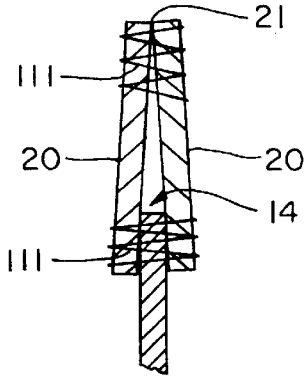

Concerning the structure of the collar, durability is enhanced if the collar member consists of a two-piece collar member sewn together as shown in FIGS. 17 and 18. The preferred steps for constructing the collar member are as follows. In FIG. 17, turn a first bottom collar edge 124 of each two-piece collar member to inside and press. Then, stitch the collar pieces together at the edge 124. Next, in FIG. 18, turn a second bottom collar edge 126 and press. Then, in FIG. 19 the collar member is stitched to the neck aperture portion 14 (seen assembled in FIG. 31).

Next, seen in FIGS. 21 and 22, the first sleeve member 32 is connected to the first arm aperture portion 16 and the second sleeve member 38 is connected to the second arm aperture portion 18 (not specifically shown but being similar to the steps for connecting the first sleeve member. Excellent results towards achieving a finished product include connecting the first and second sleeve members to their respective first and second arm aperture portions by means of a serge type stitching (shown in FIG. 29). Then, stitching by a serge stitch the left first sleeve edge 110 to the right first sleeve edge 112 and also serging the left second sleeve edge 114 to the right second sleeve edge 116.

Figure 5:
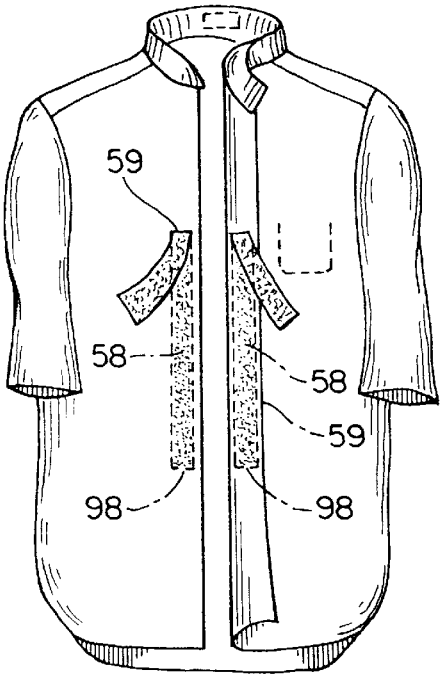
FIG. 5 is a front view of the dress shirt shown in FIG. 4, here demonstrating a second step for making our invention.
Figure 5A:
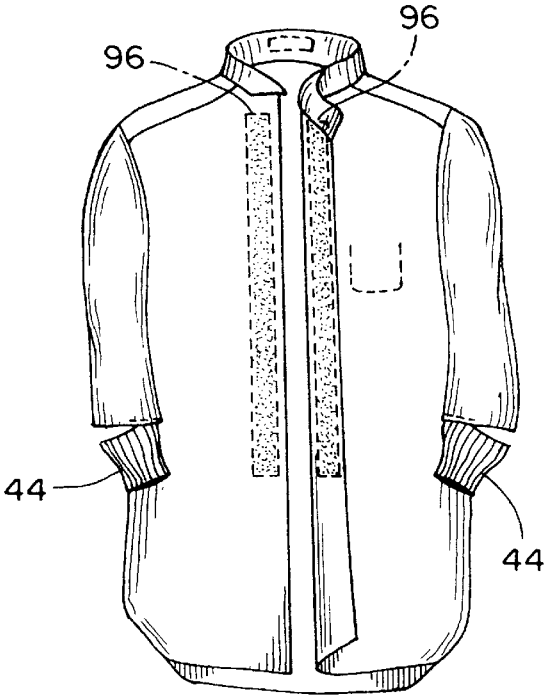
FIG. 5*a* is a front view of the dress shirt shown in FIG. 5, here demonstrating the complete second step and commencing a third step for making our invention.
Figure 6:
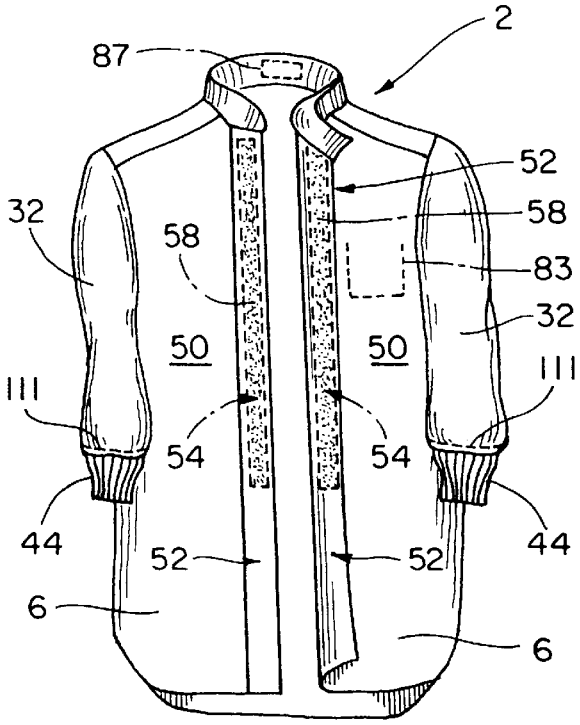
FIG. 6 is a back view of our garment assembly shown in FIG. 1, here demonstrating our invention fully converted into a light weight upper torso outer garment assembly for use by a child wearing underlying clothing when making arts and crafts in accordance with the features of our invention.
Figure 6A:
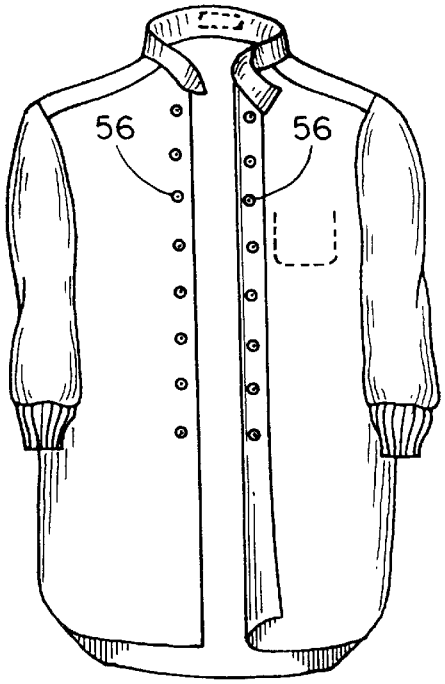
FIG. 6*a* is a back view of our garment assembly shown in FIG. 1, here demonstrating another embodiment of our invention fully converted into a light weight upper torso outer garment assembly for use by a child wearing underlying clothing when making arts and crafts in accordance with the features of our invention.
Figures 7A, 7B:
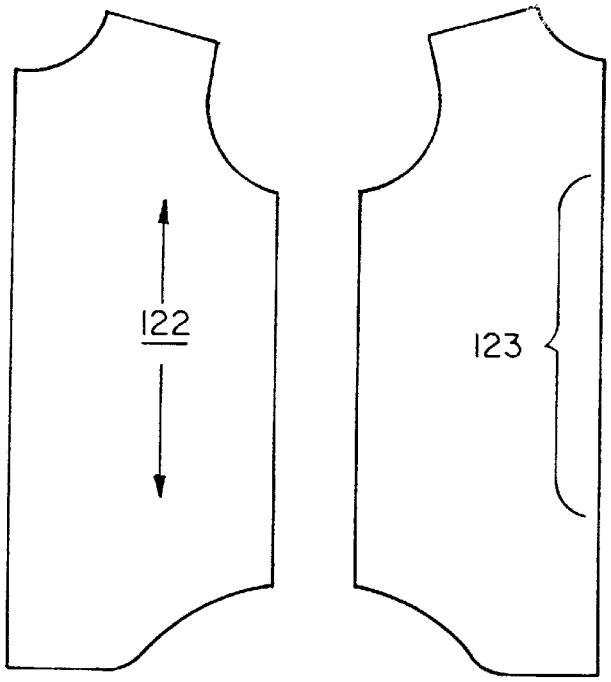
FIGS. 7*a*–7*e* are a top plan view of a pattern comprising pattern parts for sizing and cutting out pieces of material used in a second embodiment for making our invention.
Figure 7E:
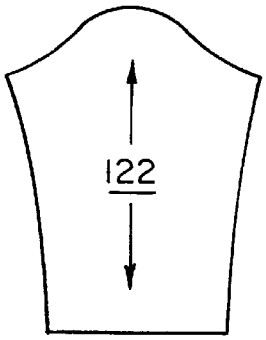
Figure 7C:
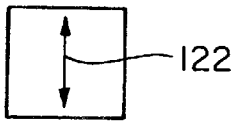
Figure 7D:
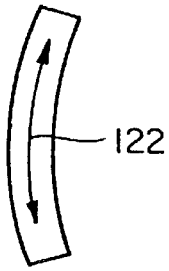

Next, shown in FIGS. 5 and 5*a*, our garment assembly 2 comprises attaching a back end securing member 54 from the group consisting of a snap type fastener 56 and a hook-and-look type fastener 58, to the pair of opposed vertically extending back ends 52. As explained in detail earlier in this specification, excellent results are obtained when the hook-and-look type fastener consists of a pair of mating members extending from a first position 96 adjacent the collar member to a second position 98 in a range of one-half to three-quarters a vertical length of the pair of opposed vertically extending back ends. Moreover, it is preferred that the mating members are each sewn to each respective opposed vertically extending back end of the pair of opposed vertically extending back ends to increase the durability and longevity of the operable mating members.

Figure 23:
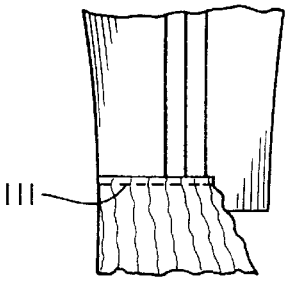
FIG. 23 is a partial inside view of one of a pair of elongated, knit-elastic cuff structures being connected to a sized sleeve member and also demonstrating a step for finishing the connection.
Figure 24:
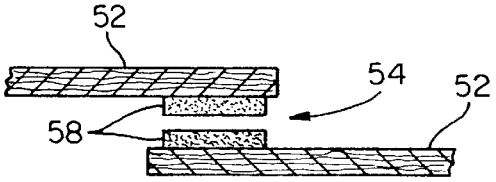
FIG. 24 is a partial exploded cross sectional view of a back end securing member connected to the pair of opposed vertically extending back ends, the back end securing member comprising a hook and loop type fastener.
Figure 25:
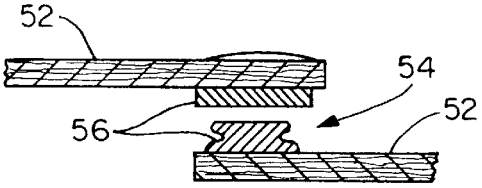
FIG. 25 is a partial exploded cross sectional view of a back end securing member connected to the pair of opposed vertically extending back ends, the back end securing member comprising a snap type fastener.
Figure 26:
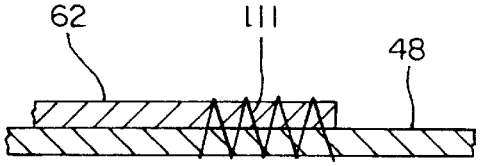
FIG. 26 is a partial exploded cross sectional view of a pocket member sewn to a continuous front surface.

Finally, shown in FIG. 23, the last step required to complete our garment assembly 2 comprises connecting one member from the pair of elongated, knit-elastic cuff structures 44 to each respective first and second sleeve members 32 and 38. Again, towards the end of achieving a finished product, excellent results are obtained when the step of connecting the pair of elongated, knit-elastic cuff structures to the pair of sleeves comprises serging the elongated, knit-elastic cuff structures to the pair of sleeves (seen in FIG. 30).

As various possible embodiments may be made in the above invention for use for different purposes and as various changes might be made in the embodiments and method above set forth, it is understood that all of the above matters here set forth or shown in the accompanying drawings are to be interpreted as illustrative and not in a limiting sense.

We claim:

1. A method for converting an adult dress shirt into a light weight upper torso outer garment assembly for use by a child wearing underlying clothing when making arts and crafts, the upper torso outer garment assembly including a continuous front surface and a vertically split back surface, the vertically split back surface including a pair of opposed vertically extending back ends, the adult dress shirt including an upper torso covering structure, a pair of sleeves attached to the upper torso covering structure, a collar attached to the upper torso covering structure, a set of buttons attached to the upper torso covering structure by a third stitching, a pocket member attached to the upper torso covering structure by a first stitching, a pair of cuffs attached to the sleeves, a label attached to the collar by a second stitching, the collar consisting of an upper folded-over portion attached to a collar member having a pair of opposed collar ends, a right pair of shortened bottom edges located along a right side edge between the continuous front surface and the vertically split back surface, a left pair of shortened bottom edges located along a left side edge between the continuous front surface and the vertically split back surface, the improvement comprising the steps of:

removing the pair of cuffs, the label, the set of buttons, the pocket member and the upper folded-over portion;

attaching a back end securing member from the group consisting of a snap type fastener and a hook-and-loop type fastener to the pair of opposed vertically extending back ends; and, connecting a pair of elongated, knit-elastic cuff structures to the pair of sleeves.

2. The method of claim 1, further including the step of sewing the pocket member to the front surface with at least a portion of the pocket member being located in a horizontal plane coinciding with the pair of elongated, knit-elastic cuff structures.

3. The method of claim 1, wherein the step of removing the upper folded-over portion of the collar comprises cutting away the upper folded-over portion of the collar at a sew line located between the upper folded-over portion and the collar member and then discarding the upper folded-over portion.

4. The method of claim 1, wherein the step of removing the pair of cuffs further comprises respectively sizing a length of each of the pair of sleeves, and then, cutting the length off preparatory to connecting the pair of elongated, knit-elastic cuff structures to the pair of sleeves, and then, discarding the length and corresponding each of the pair of cuffs.

5. The method of claim 2, wherein the step of removing the pocket comprises ripping the first stitching securing the pocket member to the upper torso covering structure preparatory to sewing the pocket member on the vertically split back surface.

6. The method of claim 1, wherein the step of removing the label comprises ripping the second stitching attaching the label to the collar member, and then, discarding the label.

7. The method of claim 1, wherein the step of removing the set of buttons comprises ripping the third stitching securing the set of buttons to the upper torso covering structure, and then, discarding the set of buttons.

8. The method of claim 1, wherein the step of connecting the pair of elongated, knit-elastic cuff structures to the pair of sleeves comprises sewing the elongated, knit-elastic cuff structures to the pair of sleeves.

9. The method of claim 1, wherein the step of attaching the back end securing member, with the hook-and-loop type fastener consisting of a pair of mating members extending from a first position adjacent the collar member to a second position in a range of one-half to three-quarters a vertical length of the pair of opposed vertically extending back ends, comprises sewing each member of the pair of mating members to each respective opposed vertically extending back end of the pair of opposed vertically extending back ends.

10. A method for making a light weight upper torso outer garment assembly for use by a child wearing underlying clothing when making arts and crafts, comprising the steps of:

providing (1) a sheet of material for creating the upper torso outer garment assembly and (2) a pair of elongated, knit-elastic cuff structures;

providing a pattern comprising pattern parts for cutting out pieces of material used in the manufacture of the upper torso outer garment assembly;

sizing and cutting pieces of material from the sheet of material using the pattern parts to create (1) a continuous front surface having a right front shortened bottom edge and a left front shortened bottom edge, (2) a vertically split back surface where the vertically split back surface includes a pair of opposed vertically extending back ends, a right back shortened bottom edge and a left back shortened bottom edge, (3) a first sleeve member including a left first sleeve edge and a right first sleeve edge, (4) a second sleeve member including a left second sleeve edge and a right second sleeve edge, (5) a collar member and (6) a pocket member;

connecting the continuous front surface to the vertically split back surface at a top edge and thereby also forming a neck aperture portion;

connecting the continuous front surface to the vertically split back surface at a left side edge and at a right side edge and thereby also forming a first arm aperture portion and a second arm aperture portion;

connecting the collar member to the neck aperture portion;

connecting the first sleeve member to the first arm aperture portion;

connecting the second sleeve member to the second arm aperture portion;

attaching a back end securing member from the group consisting of a snap type fastener and a hook-and-loop type fastener to the pair of opposed vertically extending back ends; and connecting one member from the pair of elongated, knit-elastic cuff structures to each respective first and second sleeve members.

11. The method of claim 10, further including the step of attaching the pocket member to the continuous front surface with at least a portion of the pocket member being located in a horizontal plane coinciding with the pair of elongated, knit-elastic cuff structures.

12. The method of claim 10, wherein the pocket member comprises a two-piece pocket member sewn together and the collar member comprises a two-piece collar member sewn together.

13. The method of claim 10, wherein the step of connecting the continuous front surface to the vertically split back surface at the top edge comprises serging the continuous front surface to the vertically split back surface at the top edge and the step of connecting the continuous front surface to the vertically split back surface at the left side edge and at the right side edge comprises serging the continuous front surface to the vertically split back surface at the left side edge and at the right side.

14. The method of claim 10, wherein the step of connecting the first sleeve member to the first arm aperture portion comprises serging the first sleeve member to the first arm aperture portion and then serging the left first sleeve edge to the right first sleeve edge, and the step of connecting the second sleeve member to the second arm aperture portion comprises serging the second sleeve member to the second arm aperture portion and then serging the left second sleeve edge to the right second sleeve edge.

15. The method of claim 10, wherein the step of connecting the pair of elongated, knit-elastic cuff structures to the pair of sleeves comprises serging the elongated, knit-elastic cuff structures to the pair of sleeves.

16. The method of claim 10, wherein the step of attaching the back end securing member, with the hook-and-look type fastener consisting of a pair of mating members extending from a first position adjacent the collar member to a second position in a range of one-half to three-quarters a vertical length of the pair of opposed vertically extending back ends, comprises sewing each member of the pair of mating members to each respective opposed vertically extending back end of the pair of opposed vertically extending back ends.

17. A light weight upper torso outer garment assembly for use by a child wearing underlying clothing when making arts and crafts, comprising:

an upper torso covering structure for loosely-hanging encirclement about a child extending from a shoulder portion of a child to below a waist portion of a child and above a knee portion of a child, the upper torso covering structure including a neck aperture portion, a first arm aperture portion and a second arm aperture portion;

non-elastic collar structure means circumferentially secured to the neck aperture portion for selectively sizable loose-fitting neck-encompassing positioning about a child's neck and for preventing the underlying clothing from exposing itself to an environment outside the outer garment assembly when the child is making arts and crafts;

a first sized sleeve member having a first sleeve upper end and a first sleeve lower end, the first sleeve upper end being completely circumferentially connected to the first arm aperture portion;

a second sized sleeve member having a second sleeve upper end and a second sleeve lower end, the second sleeve upper end being completely circumferentially connected to the second arm aperture portion;

a pair of elongated, knit-elastic cuff structures for snugly-fitting, wrist-encompassing engagement around a child's wrist and for preventing the underlying clothing from exposing itself to an environment outside the outer garment assembly when the child is making arts and crafts, each of the pair of elongated, knit-elastic cuff structures being completely circumferentially connected to each respective first sleeve and second sleeve lower ends;

the upper torso covering structure including a continuous front surface and a vertically split back surface;

a right pair of shortened bottom edges located along a right side edge between the continuous front surface and the vertically split back surface and a left pair of shortened bottom edges located along a left side edge between the continuous front surface and the vertically split back surface, the right and left pairs of shortened bottom edges assisting the child in moving about and sitting down while wearing the upper torso outer garment assembly; and, the vertically split back surface including reclosable split back means for selectively opening and closing the back surface to enable the child to become encircled by the upper torso outer garment assembly without the child having to pull the upper torso outer garment assembly over a head of the child and for preventing the underlying clothing from exposing itself to an environment outside the outer garment assembly when the child is making arts and crafts.

18. The upper torso outer garment assembly of claim 17, wherein the front surface of the upper torso covering structure includes a pocket member attached to the front surface with at least a portion of the pocket member being located in a horizontal plane coinciding with the pair of elongated, knit-elastic cuff structures.

19. The upper torso outer garment assembly of claim 17, wherein the reclosable split back means comprises a pair of opposed vertically extending back ends, a back end securing member from the group consisting of a snap type fastener and a hook-and-loop type fastener, the back end securing member extending from a first position adjacent the non-elastic collar structure means to a second position in a range of one-half to three-quarters a vertical length of the pair of opposed vertically extending back ends, said positioning of the back end securing member assisting the child in sitting down and positioning a front lower edge portion of the upper torso outer garment assembly over an upper leg portion of the child, and the back end securing member being connected to the pair of opposed vertically extending back ends so thereby the pair of opposed vertically extending back ends are selectively securable together by operation of the back end securing member.

20. The upper torso outer garment assembly of claim 19, wherein the non-elastic collar structure means comprises a collar member circumferentially secured to the neck aperture portion, the collar member having a pair of opposed collar ends located adjacent the back end securing member, the pair of opposed collar ends being selectively positioned together in coordination with the selective opening and closing of the pair of opposed vertically extending back ends.

21. The upper torso outer garment assembly of claim 19, wherein the vertically split back surface includes pocket stitching holes therein and the collar member includes label stitching holes therein.

* * * * *